US005430966A

United States Patent [19]

Hippensteel

[11] Patent Number: 5,430,966

[45] Date of Patent: Jul. 11, 1995

[54] SHOTGUN SHELL DE-JAMMING DEVICE

[76] Inventor: Thomas O. Hippensteel, 24 Clover Hill La., Laguna Hills, Calif. 92656

[21] Appl. No.: 243,810

[22] Filed: May 17, 1994

[51] Int. Cl.[6] ..... F41A 15/00

[52] U.S. Cl. ..... 42/90

[58] Field of Search ..... 42/90, 95; 81/3.05

[56] References Cited

U.S. PATENT DOCUMENTS

| | | | |
|---|---|---|---|
| 892,230 | 6/1908 | Donati | 81/3.05 |
| 2,774,090 | 12/1956 | Allinson | 42/90 |
| 3,898,908 | 8/1975 | Isenhower et al. | 81/3.05 |
| 4,813,169 | 3/1989 | Calliebe | 42/90 |
| 4,890,406 | 1/1990 | French | 42/90 |

FOREIGN PATENT DOCUMENTS

| | | | |
|---|---|---|---|
| 2244798 | 12/1991 | United Kingdom | 42/95 |

*Primary Examiner*—Charles T. Jordan
*Assistant Examiner*—Theresa M. Wesson

[57] ABSTRACT

A cylindrical device with flared and rounded ends for use in instantly dislodging spent (fired) shotgun shells from the breech opening of shotguns. The shell de-jammer comprises a cylindrical solid body member of sufficient weight and density to quickly and easily dislodge a spent shotgun shell that has become stuck in the breech. The device is loaded axially into the open end of a barrel and dropped vertically down the barrel with the dead weight impact force of the device instantly dislodging the stuck shell. The construction and coating of the device is such that it does not scratch or damage the gun bore defining surface or ejection or closing mechanisms of the gun.

16 Claims, 3 Drawing Sheets

SHOTGUN SHELL DE-JAMMING DEVICE

BACKGROUND—FIELD OF INVENTION

This invention relates to shotguns, specifically to a device for easily and quickly dislodging a spent shell that is difficult to remove due to the ejection mechanism failing to clear it automatically from the breech.

BACKGROUND—DESCRIPTION OF PRIOR ART

Shotgun shells become stuck in a shotgun's breech or ejection mechanism s because of a faulty or malfunctioning ejection mechanism or because the shell swelled or became distorted and was out of tolerance with respect to the shell's outside diameter in relation to the gun bore diameter. This is a common occurrence with shells that have been repeatedly reloaded and reused. When a shell becomes jammed, the shooter frequently tries to pry it out using a knife or other metal tool or tries to push it out by ramming a rod or stick down the barrel. The use of a knife or similar tool may cause damage to the gun, ejection mechanism, or to the knife itself. The use of a stick may introduce undesirable foreign material into the gun's operating mechanisms. Finding a stick may be difficult or impossible when in a boat or duck blind or when hunting in rocky or desert areas. A cleaning rod of sufficient length is often not practicable to carry in hunting or shooting situations. Neither the knife prying, cleaning rod and stick ramming methods are desirable to the shooter who wants to get back into action quickly.

OBJECTS AND ADVANTAGES

Accordingly, the object and advantages of my shell de-jammer invention are the quick, efficient, positive removal of shotgun shells that have become stuck in a gun barrel or ejection mechanism.

The de-jammer can be considerable safer than other methods, because once dropped down the open barrel, hands are not near the end of the barrel or the breech mechanisms.

The de-jammer is very portable and readily available to the shooter as it is relative small and compact and thus can be easily and conveniently carried in a pocket, shell vest pouch, or a belt carrying a sheath. A plastic coating protects it during storage, while carrying it and when used. The inner surfaces of the barrel bore have protection from scratching and damage because of the coating on the De-Jammer device.

DESCRIPTION OF DRAWINGS

FIG. 1 *a* is a cross sectional view of the invention showing the body material and coating.

Figure 1:
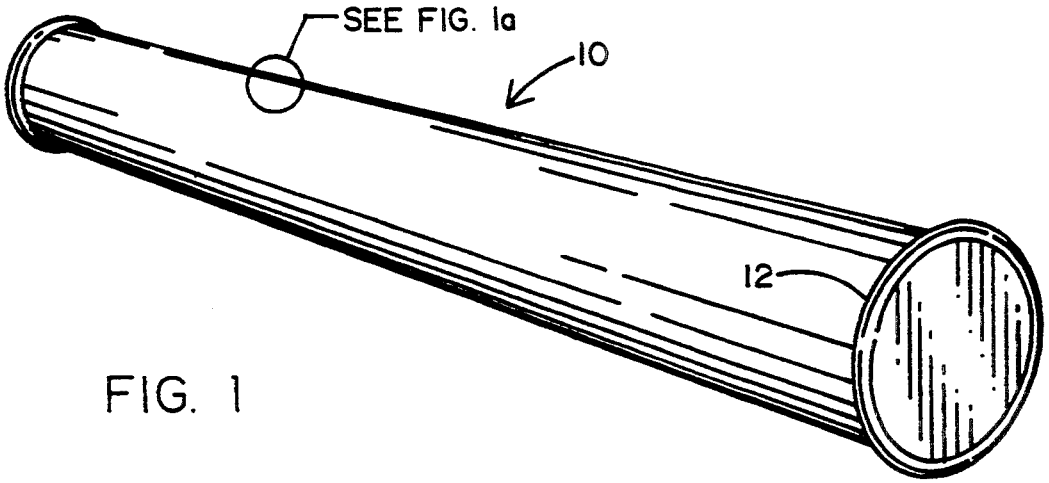
FIG. 1 is an isometric view and representation of the shell de-jammer.
Figure 1A:
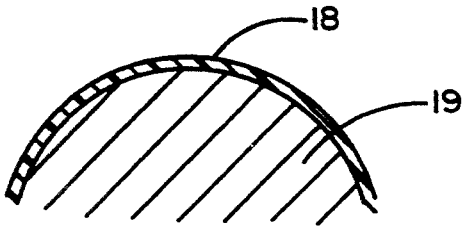

| List of Reference Numerals | |
|---|---|
| 10 | Cylindrical body of the invention |
| 12 | Rounded flared ends |
| 16 | Fore and aft ends of invention are identical |
| 18 | Coating |
| 19 | Cross section of the body of the invention |
| 20 | Barrel |
| 22 | Barrel's bore |
| 24 | Bore defining surface, barrel's inside diameter |
| 26 | Nozzle open end of the barrel |
| 28 | Shell lodged in the bore of the breech end of the barrel |
| 30 | Shotgun shell |

SUMMARY

DESCRIPTION OF INVENTION

Referring now to the drawings, and more specifically to FIG. 1, a shotgun shell de-jammer device 10 of the present invention is illustrated in a isometric view. In this view fore and aft ends 16 of the invention are shown as being similar. The fore and aft ends 16 are rounded and flared 12. Referring now FIG. 1 *a*., the cylindrical body 19 of the invention 10 is coated.

Figure 2:
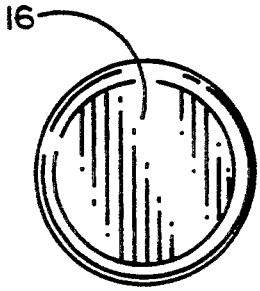
FIG. 2 is an isometric view of the fore and aft ends of the present invention; the shell de-jammer.
Figure 3:
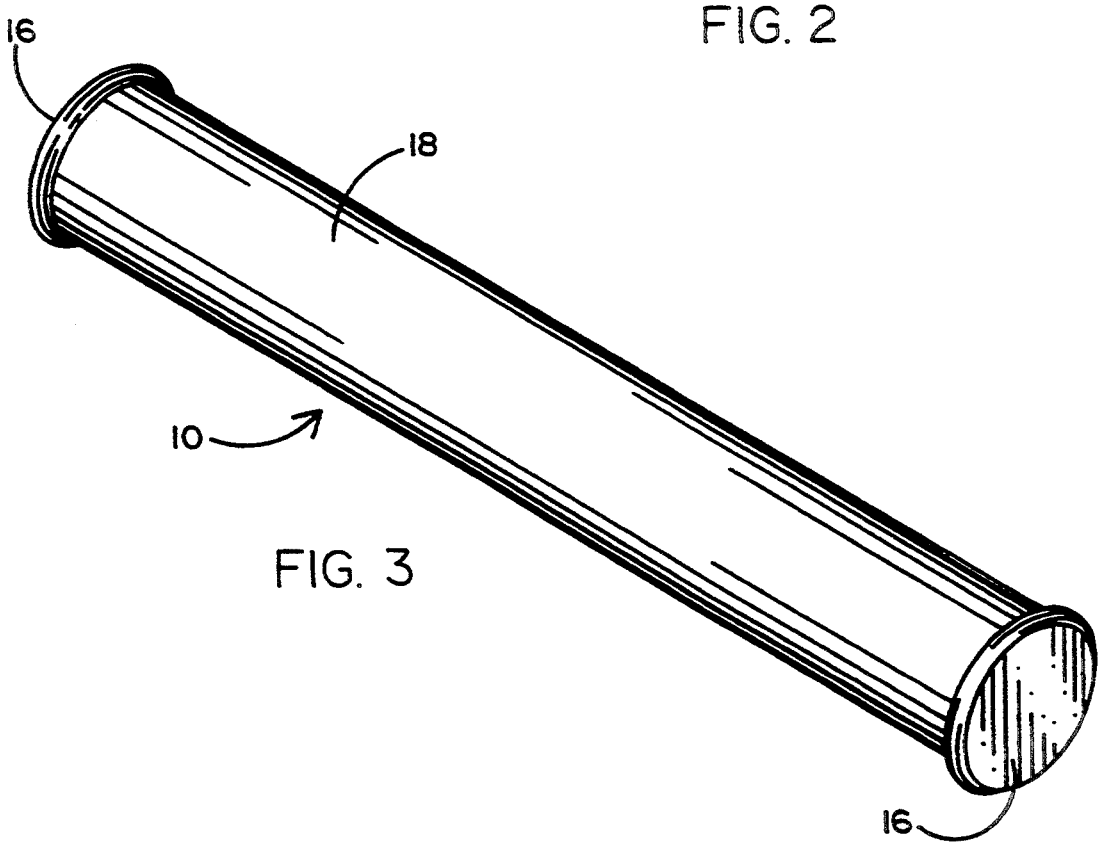
FIG. 3 is an isometric view of present invention showing the body, ends and coating.

Referring to FIG. 2 the rounded and flared surfaces and the fore and aft ends 16 are shown. Referring now to FIG. 3 the body 19 and the coating 18 of the invention 10 and the fore and aft ends 16 are shown.

Figure 4:
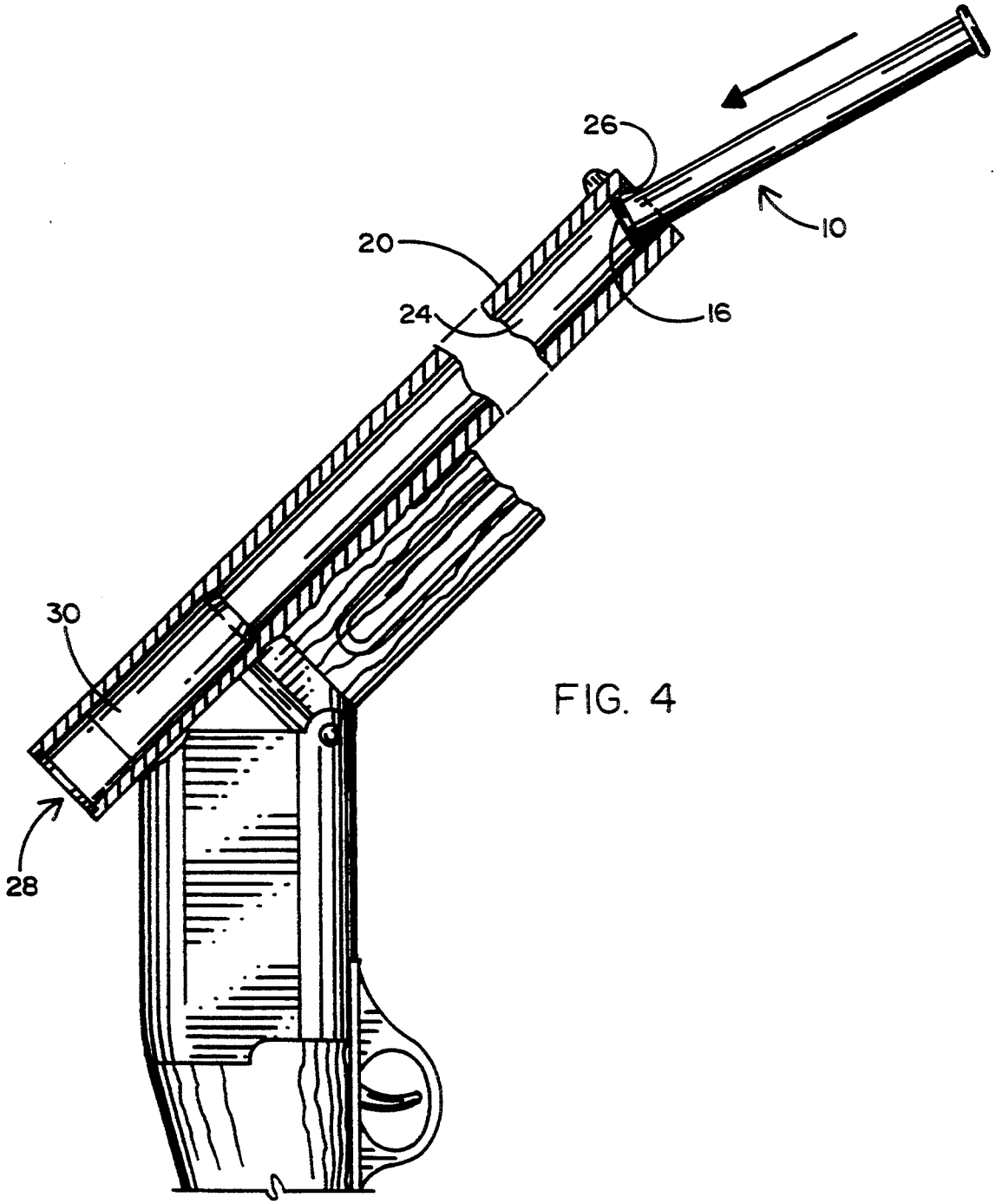
FIG. 4 is a pictorial representation, partially in cross section, of a shotgun barrel wherein a shotgun shell is being shown as lodged in the barrel bore and the invention is shown as being inserted.
Figure 5:
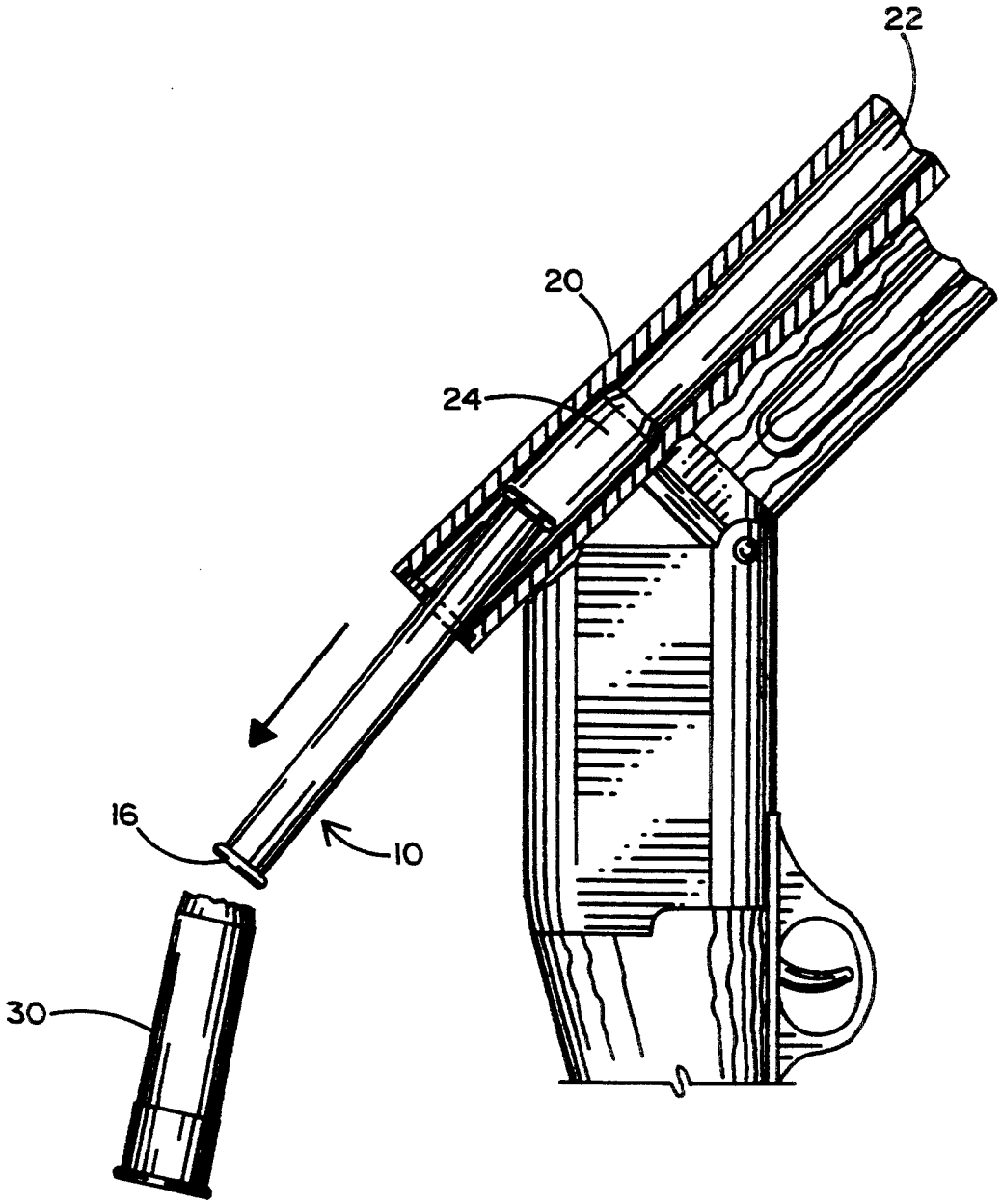
FIG. 5 is a pictorial representation, partially in cross section, of a shotgun barrel wherein a shotgun shell is being shown as dislodged from the barrel bore after contact with the invention after being inserted into the barrel's bore.

In FIG. 4 in the invention fore or aft ends 16 and the rounded and flared ends contact the bore defining surfaces 24 of the barrel 20. Referring now to the drawings, and more specifically to FIG. 5, a shotgun shell de-jammer device 10 of the present invention is illustrated disposed in a shotgun barrel's bore 22 partially shown. The barrel 20 is provided with a breach, a nozzle 26 and a bore 22 extending there through and defined by bore defining surface 24. The bore 22 and bore defining surface 24 of the barrel 20 is illustrated, and concerns regarding the construction and gauge of the barrel 20 are not believed necessary herein to understand and appreciate the improvements of the shell de-jamming and dislodging device 10 of the present invention. Referring to FIG. 4 the shell de-jamming and dislodging device 10 is inserted into the bore opening through the nozzle 26 of which the diameters are larger than the flared and rounded fore and aft ends 16 of the present invention and can be moved through the bore defining surface 24 from the point of entering the nozzle 26 to the breech 28 end and out through the nozzle 26 of a barrel 20 or the breech 28 upon dislodging and freeing the jammed or lodged shell 30.

The configuration of the device 10, its weight, and coated exterior surfaces 18 that contact the bore defining surface 24 ensure that the shell 30 is readily dislodged without scratching or damaging to the bore defining surface 24 as the rounded and flared fore and aft ends 16 uniformly contact the bore defining surface 24 of the barrel 20 as the device 10 is moved through the bore defining surface 24 by action of gravity or force applied as it is entering the nozzle 26 of the barrel 20 and moves through the bore defining surface 24 to come into contact with the jammed or lodged shell 28. The shell is pushed towards the open breach end by the shell de-jamming device 10, and the device may be returned through the breech or the barrel's nozzle end 26 and out towards the ground with the nozzle facing the earth to allow gravity to move it through the bore defining surface 24 away from the breech end of the barrel.

The shell de-jamming and dislodging device 10 is a cylindrical body shaped with two ends that are rounded and flared circular in diameter, and rounded larger than the cylindrical body 19, and of sufficient in size to prevent entry into the magazine loading compartment mechanisms of automatic shotguns. The ends fore 16 and aft 16 are similar in construction and shape.

It is to be understood that the cylindrical body and ends can be fabricated of any material having the desired rigidity, weight, density and coating, so that the and diameters of the fore and aft areas and body 10 abuttingly engage the shell 30 that is lodged or jammed in the bore defining surface 24 of the barrel 20. Further the complete body 10 of the device, the cylindrical rod and rounded and flared fore and aft ends 16 are preferably fabricated as one unit from Ledloy, C12L14 19 and coated 18 with a powder type of plastic polymer coating made by TIGER of Rancho Cucamonga, California. The powder coating is a trade name of DRYLAC which is a registered trademark and is a material, either natural or synthetic, having the desired properties of not damaging or scratching the bore defining surface 24 of the barrel 20 or any other of the guns mechanisms or surfaces is preferred. The ends and body in the preferred embodiment are of different diameters to facilitate insertion and use in the bore defining surface 24 of the barrel 20 and may be equal in some ramifications. The coating material is sufficiently smooth to allow it to slide through the gun barrel 20 bore defining surface 24 without damage to it or becoming lodged in it. It will be appreciated that many polymeric materials will also be candidates for the selected material to cover the body 10 and ends 16 of the invention, the shell de-jammer, and dislodging device.

Because of the desire to forcefully and abuttingly engage a jammed or lodged shell the cylinder body 10 and rounded and flared fore and aft ends 16 do contact the bore defining surface 24 and as well the fore and aft ends 16 are to contact and strike the shell casing nose end of the lodged shell in the breech of the barrel 28. The coating must be resistant to gun powders, and primer's chemical components, and the entire cylindrical body 10 and ends are formed as one unit and of a weight and density to dislodge a shell 28 from the bore defining surface 24 and push it through the breech end. For single and double shot guns, the device can be removed by the action of lowering the barrel toward the earth. For automatic shotguns with multiple shells, the unit is sufficient in length to prevent it from entering the loading magazine or compartment.

It will be clear that the present invention of a shell de-jammer is well adapted to carry out the objects and advantages and to attain the advantages mentioned as well as those inherent therein. While presently the preferred embodiments of the invention of the shell de-jammer have been described for purposes of this disclosure, numerous changes can be made which will readily suggest themselves to these skilled in the art which are encompassed within the spirit of the invention of the shell de-jammer disclosed and defined in the appended claims.

OPERATION OF INVENTION

Referring to FIG. 4, the manner of using the shell de-jamming device to dislodge, remove and de-jam a shotgun shell from the gun barrel bore defining surface 24 is accomplished very easily. With the gun's breech mechanism held open or in the locked open position and while pointing the gun in a safe direction, the de-jamming device 10, by its rounded and flared fore or aft ends can be inserted into the nozzle 26 of the barrel 20 and dropped into the bore defining surface 24 of the barrel 20. The weight and design of the de-jammer's cylindrical body 10 and rounded and flared fore and aft ends 16 provide sufficient force to abuttingly engage the shell, forcing the lodged or jammed shell 28 free from being jammed into the barrel's bore defining surface 24, and the shell 30 is pushed out of the open breech and out of the gun. The shell de-jammer device is coated and does not scratch or damage the gun's barrel bore defining surface 24 or other mechanisms. The length of the de-jammer's body 10 is sufficient to prevent it from entering the magazine loading compartment. The shell de-jamming 10 can be removed from the barrel when lowered towards the ground; it slides out the nozzle end of the barrel 20.

CONCLUSION, RAMIFICATIONS, AND SCOPE OF INVENTION

Accordingly the reader will see that the shotgun de-jammer and dislodging device provides an efficiently, quick and expeditious method that is convenient and a simple solution for the removal of jammed and lodged shells. The invention is a convenient device to dislodge and remove shot gun shells, from the breech of shotguns, that have become lodged or jammed. The present invention may be used with or made for a variety of shotgun gauges but is shown as being used with a 12-gauge shotgun for illustration. It is not limited to a particular gauge of shotgun shell or barrel gauge. The de-jammer has a special self lubricating smooth coating that prevents scratching or metal to metal damage to the barrel or closing and ejection mechanisms. The invention may even be made from or encapsulated by a suitable nonscratching or noncorrosive material.

The de-jammer can be coated with highly visible coating making it easy to find if accidentally dropped in shallow water, snow, or grass. The de-jammer special polyester exterior powder coatings are long lasting and resist rusting, damage, and moisture retention. It can be easily cleaned by a quick wiping and can be successfully used for many years. The de-jammer enables the hunter or shooter to instantly return to active shooting which is extremely critical in duck and upland game hunting situations. When using the invention there is no need to field strip or disassemble the gun which may be difficult or impossible without special tools. The use of the de-jammer is cost effective; it allows the thrifty shooter to save considerable money by doing his own reloading without fear of stuck shells negating hunting or shooting activities.

I claim:

1. A device for dislodging spent shotgun shells from a shotgun having a barrel with a breech opening, said device comprising:

an elongated cylindrical body formed of a dense material, having a diameter less than the diameter of the barrel of said shotgun; and symmetrical fore and aft ends attached to said elongated cylindrical body, said ends having flat surfaces opposite the attachment to said elongated cylindrical body, said ends having rounded sides, and said ends having a diameter that is slightly larger than the diameter of said elongated cylindrical body, but less than the diameter of the barrel of said shotgun.

2. A device as claimed in claim 1, wherein the length and height of said fore and all ends is many times less than the length of said elongated cylindrical body.

3. A device as claimed in claim 1, wherein the length of said device, including said elongated cylindrical body and said fore and aft ends, is less than the length of the barrel of said shotgun.

4. A device as claimed in claim 2, wherein the length of said device, including said elongated cylindrical body and said fore and aft ends, is less than the length of the barrel of said shotgun.

5. A device as claimed in claim 1, further comprising a self-lubricating and non-abrasive encapsulating material.

6. A device as claimed in claim 2, further comprising a self-lubricating and non-abrasive encapsulating material.

7. A device as claimed in claim 3, further comprising a self-lubricating and non-abrasive encapsulating material.

8. A device as claimed in claim 4, further comprising a self-lubricating and non-abrasive encapsulating material.

9. A device as claimed in claim 1, wherein said device is lightweight.

10. A device as claimed in claim 2, wherein said device is lightweight.

11. A device as claimed in claim 3, wherein said device is lightweight.

12. A device as claimed in claim 4, wherein said device is lightweight.

13. A device as claimed in claim 5, wherein said device is lightweight.

14. A device as claimed in claim 6, wherein said device is lightweight.

15. A device as claimed in claim 7, wherein said device is lightweight.

16. A device as claimed in claim 8, wherein said device is lightweight.

* * * * *